US010369813B2

(12) United States Patent
Nagasawa et al.

(10) Patent No.: US 10,369,813 B2
(45) Date of Patent: Aug. 6, 2019

(54) CONVEYOR, DRYER, AND PRINTER

(71) Applicants: Satoru Nagasawa, Kanagawa (JP); Ken Onodera, Kanagawa (JP); Toshihiro Yoshinuma, Kanagawa (JP)

(72) Inventors: Satoru Nagasawa, Kanagawa (JP); Ken Onodera, Kanagawa (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/875,536

(22) Filed: Jan. 19, 2018

(65) Prior Publication Data

US 2018/0264848 A1 Sep. 20, 2018

(30) Foreign Application Priority Data

Mar. 16, 2017 (JP) ..... 2017-050936

(51) Int. Cl.
*B41J 11/00* (2006.01)
*B41J 13/08* (2006.01)
(Continued)

(52) U.S. Cl.
CPC ..... *B41J 11/002* (2013.01); *B41J 2/175* (2013.01); *B41J 13/076* (2013.01); *B41J 13/08* (2013.01);
(Continued)

(58) Field of Classification Search
CPC ..... B41J 13/103; B41J 13/08; B41J 11/002; B41J 11/0045; B41J 15/04; B41J 15/16; F26B 13/18; F26B 13/14; F26B 13/08
See application file for complete search history.

(56) References Cited

U.S. PATENT DOCUMENTS 772,695 A * 10/1904 Crowell ..... C23C 2/38 118/223
3,319,352 A * 5/1967 Haigh ..... F26B 13/18 162/206
(Continued)

FOREIGN PATENT DOCUMENTS

| | | |
|---|---|---|
| JP | 11-258949 | 9/1999 |
| JP | 2005-238752 | 9/2005 |
| JP | 2016-088640 | 5/2016 |

OTHER PUBLICATIONS

U.S. Appl. No. 15/652,478, filed Jul. 18, 2017 Wataru Sakamoto, et al.

*Primary Examiner* — John Zimmermann
(74) *Attorney, Agent, or Firm* — Duft & Bornsen, PC

(57) ABSTRACT

A conveyor for printer includes, a first guide, a second guide disposed separately from the first guide, a third guide disposed between the first guide and the second guide, the first guide, the second guide, and the third guide defining a conveyance path along which a medium is conveyed, and a loading guide movable to guide the medium between the first guide and the second guide. The third guide is movable between a first position and a second position. The third guide presses the medium to the first guide and the second guide at the first position and is separated from the medium at the second position. The loading guide is disposed at a guiding position to guide the medium and is disposed at a retracted position retracted from the guiding position in response to the third guide disposed at the first position.

13 Claims, 15 Drawing Sheets

(51) Int. Cl.

| | |
|---|---|
| ***B41J 15/16*** | (2006.01) |
| ***B41J 2/175*** | (2006.01) |
| ***B41J 13/076*** | (2006.01) |
| ***F26B 3/28*** | (2006.01) |
| ***B41J 15/04*** | (2006.01) |
| ***F26B 13/12*** | (2006.01) |
| ***F26B 13/18*** | (2006.01) |

(52) U.S. Cl.
CPC ..... *B41J 15/04* (2013.01); *B41J 15/16* (2013.01); *F26B 3/28* (2013.01); *F26B 13/12* (2013.01); *F26B 13/18* (2013.01)

(56) References Cited

U.S. PATENT DOCUMENTS

| | | | | |
|---|---|---|---|---|
| 3,957,366 | A * | 5/1976 | Taylor | B65H 1/04 399/394 |
| 4,565,462 | A * | 1/1986 | Yamamoto | B41J 13/103 271/4.1 |
| 9,605,900 | B2 | 3/2017 | Boland et al. | |
| 2011/0187040 | A1* | 8/2011 | Tanahashi | B65H 5/06 271/3.18 |
| 2014/0232797 | A1 | 8/2014 | Onodera et al. | |
| 2014/0338819 | A1* | 11/2014 | Hong | B65H 23/26 156/160 |
| 2015/0174921 | A1 | 6/2015 | Onodera et al. | |
| 2016/0273832 | A1 | 9/2016 | Asada et al. | |
| 2017/0120625 | A1 | 5/2017 | Yoshinuma | |
| 2017/0157951 | A1 | 6/2017 | Onodera | |
| 2017/0266990 | A1 | 9/2017 | Yoshinuma et al. | |
| 2017/0266991 | A1 | 9/2017 | Onodera et al. | |
| 2017/0334217 | A1 | 11/2017 | Yoshinuma et al. | |

* cited by examiner

| ROLLER DIAMETER (mm) | COCKLING HEIGHT (mm) | COCKLING PITCH (mm) | VISUAL INSPECTION |
|---|---|---|---|
| 250 | 0.11 | 5 | COCKLING |
| 200 | 0.06 | 4 | COCKLING |
| 150 | 0.06 | 4.5 | COCKLING |
| 100 | 0.02 | NO PITCH | NO COCKLING |

CONVEYOR, DRYER, AND PRINTER

CROSS-REFERENCE TO RELATED APPLICATIONS

This patent application is based on and claims priority pursuant to 35 U.S.C. § 119(a) to Japanese Patent Application No. 2017-050936, filed on Mar. 16, 2017 in the Japan Patent Office, the entire disclosure of which is hereby incorporated by reference herein.

BACKGROUND

Technical Field

Aspects of the present disclosure generally relate to a conveyor, a dryer, and a printer.

Related Art

A printer that uses a continuous medium such as a continuous roll of paper or the like is known. The printer includes a feeding roller to feed the continuous medium and a winding roller to wind the continuous medium. A non-linear conveyance path is provided between the feeding roller and the winding roller, along which the continuous medium is conveyed from the feeding roller to the winding roller.

SUMMARY

In an aspect of this disclosure, a novel conveyor for a printer includes a first guide, a second guide disposed separately from the first guide, a third guide disposed between the first guide and the second guide, the first guide, the second guide, and the third guide defining a conveyance path along which a medium is conveyed, and a loading guide movable to guide the medium between the first guide and the second guide. The third guide is movable between a first position and a second position. The third guide presses the medium to the first guide and the second guide at the first position, and the third guide is separated from the medium at the second position. The loading guide is disposed at a guiding position to guide the medium. The loading guide is disposed at a retracted position retracted from the guiding position in response to the third guide disposed at the first position.

In another aspect of this disclosure, a novel dryer for drying a medium to which a liquid is applied, the dryer includes a heating drum to heat and dry the medium, a plurality of heating rollers disposed separately around the heating drum that define a conveyance path along which the medium is conveyed while contacting the plurality of heating rollers, a pressing roller disposed between adjacent two of the plurality of heating rollers, and a loading guide movable to guide the medium along an inner region of the plurality of heating rollers defined by the plurality of heating rollers and the heating drum. The pressing roller is movable between a first position and a second position. The pressing roller presses the medium to the plurality of heating roller at the first position, and the pressing roller is separated from the medium at the second position. The loading guide is disposed at a guiding position to guide the medium, and the loading guide is disposed at a retracted position retracted from the guiding position in response to the pressing roller disposed at the first position.

In still another aspect of this disclosure, a novel printer includes a liquid applier to apply liquid to a medium, a conveyor as described above, and a dryer as described above.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
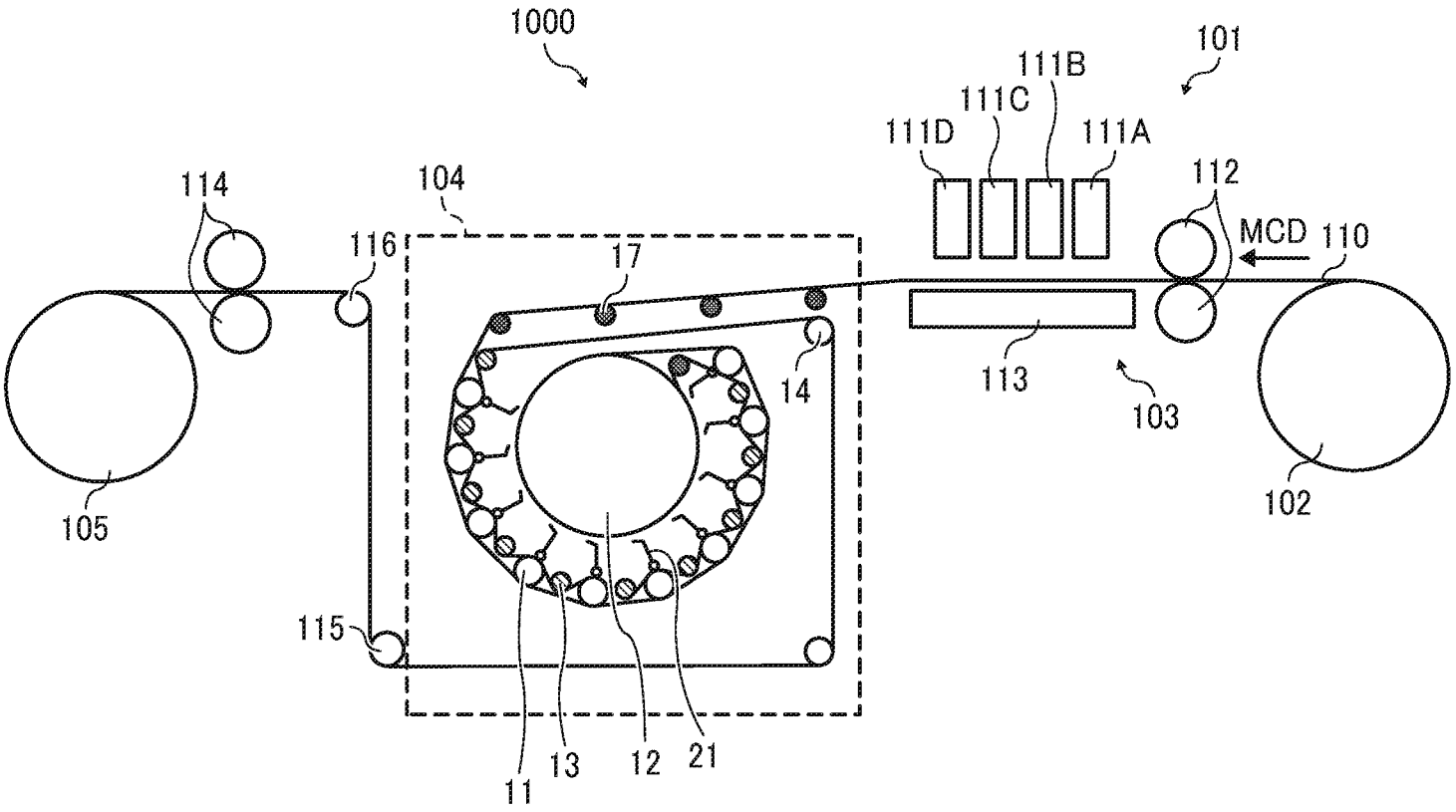
FIG. 1 is a schematic front view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

A printer 1000 according to a first embodiment of the present disclosure is described with reference to FIG. 1. FIG. 1 is a schematic front view of the printer 1000.

The printer 1000 is an inkjet recording apparatus, and includes a liquid applier 101 including a plurality of liquid discharge head 111 serving as a liquid applicator, to discharge and apply ink onto a continuous sheet 110. The ink is liquid of desired colors. The continuous sheet 110 is a medium (or member) to be conveyed. Hereinafter, "the liquid discharge head" is simply referred to as the "the head". Further, the "medium to be conveyed" is simply referred to as "medium".

The liquid applier 101 includes, for example, full-line heads 111A, 111B, 111C, and 111D (referred to as "heads 111" unless colors distinguished) of four colors are disposed in this order from the upstream side in a medium conveyance direction (MCD) of the continuous sheet 110.

The medium conveyance direction (MCD) is a direction of conveyance of the medium. The heads 111 respectively applies liquids of the colors black (K), cyan (C), magenta (M), and yellow (Y) onto the continuous sheet 110. Note that the number and types of color are not limited to the above-described four colors of K, C, M, and Y and may be any other suitable number and types.

The continuous sheet 110 fed from a feeding roller 102 is sent to a conveyance guide 113, which is disposed to face the liquid applier 101, by conveyance rollers 112 of a conveyance unit 103 and is conveyed by being guided by the conveyance guide 113.

The continuous sheet 110 onto which the liquid is applied by the liquid applier 101 passes a dryer 104 according to the present embodiment, and is sent by ejection rollers 114 via guiding rollers 115 and 116 and wound around a winding roller 105. The dryer 104 includes a conveyor 300 according to the present disclosure.

Figure 2:
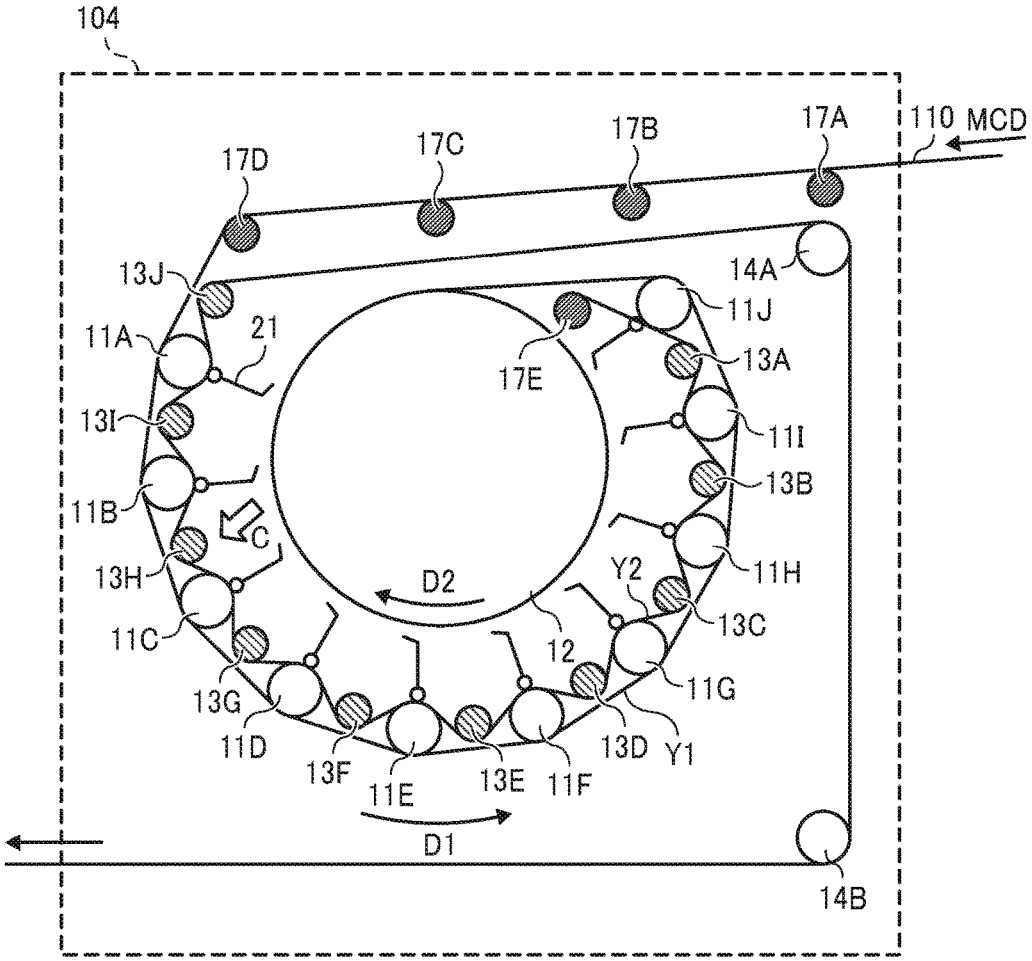
FIG. 2 is an enlarged front view of a dryer in the first embodiment.

Next, the dryer according to the first embodiment is described with reference to FIG. 2. FIG. 2 is an enlarged cross sectional view of the dryer 104.

The dryer 104 includes ten heating rollers 11 (11A to 11J), the heating drum 12, and pressing rollers 13 (13A to 13J). The heating rollers 11 serve as heaters to contact and heat a surface of the continuous sheet 110, on which the liquid is applied. The pressing rollers 13 serve as a third guide to presses the continuous sheet 110 against the heating rollers 11.

The dryer 104 further includes guide rollers 17 (17A to 17D) that guide the continuous sheet 110 to the heating roller 11A disposed at the most upstream in the medium conveyance direction (MCD), a guide roller 17E to wind the continuous sheet 110 around the heating drum 12, and heating rollers 14A and 14B to guide the continuous sheet 110 drawn out from the heating drum 12 while heating the continuous sheet 110.

Figure 3A:
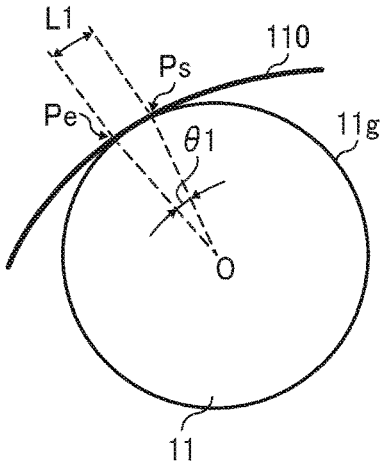
FIGS. 3A and 3B are front views of a heating roller and a heating drum illustrating a winding angle of a continuous sheet to the heating roller and the heating drum.
Figure 3B:
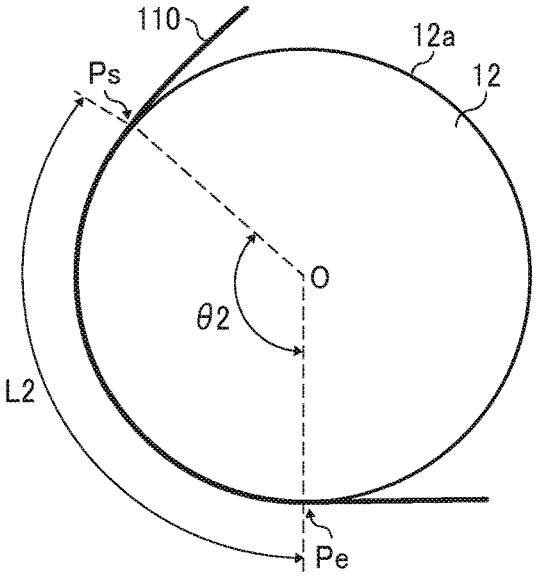

As illustrated in FIGS. 3A and 3B, a conveyance path is configured such that a contact distance L2 between a contact face 12*a* of the heating drum 12 and the continuous sheet 110 is longer than a contact distance L1 between a contact face 11*g* of each of the heating rollers 11A to 11E and the continuous sheet 110.

The "contact distance" is a distance in which the continuous sheet 110 contacts a circumferential surface of the heating drum 12 and the heating roller 11 in a direction along a circumferential direction of the heating drum 12 and the heating roller 11 (the medium feeding direction).

When the dryer 104 includes a curved surface heater that has a curved surface as a contact face, the contact distance is a distance in which the continuous sheet 110 is in contact with the curved surface in the direction (medium feeding direction) along the circumferential direction of the curved surface.

Here, a winding angle θ2 of the continuous sheet 110 with respect to the contact face 12*a* of the heating drum 12 is greater than a winding angle θ1 of the continuous sheet 110 with respect to the contact face 11*g* of the heating roller 11 (θ2>θ1).

As illustrated in FIGS. 3A and 3B, the winding angles θ2 and θ1 (collectively referred to as "winding angle θ") indicate angles of a point Ps at which the contact of the continuous sheet 110 with the contact faces 12*a* and 11*g* starts and a point Pe at which the contact of the continuous sheet 110 with the contact faces 12*a* and 11*g* ends, with respect to a center O.

Therefore, in a case where the winding angle θ increases, the contact distance also increases so long as the rotary bodies have the same diameter, and even in a case where the winding angles θ are identical to each other, the contact distance increases as the diameter of the rotary body increases.

In the present embodiment, the diameter of the heating drum 12 is greater than the diameter of the heating roller 11, and the winding angle θ2 is greater than the winding angle θ1, and thus, in any case, the contact distance L2 between the contact face 12*a* of the heating drum 12 and the continuous sheet 110 is longer than the contact distance L1 between the contact face 11*g* of the heating roller 11 and the continuous sheet 110.

As described above, even in a case where the winding angles θ are identical to each other, the contact distance increases as the diameter of the rotary body increases. Therefore, by setting the heating drum 12 and the heating roller 11 to have the same diameter, and the winding angle θ2 to be greater than the winding angle θ1, the contact distance L2 between the contact face 12*a* of the heating drum 12 and the continuous sheet 110 is longer than the contact distance L1 between the contact face 11*g* of the heating roller 11 and the continuous sheet 110.

Such a configuration can reduce cockling and improve drying efficiency.

For example, in a state where time does not elapse from the liquid application, the strength of the continuous sheet 110 decreases. Accordingly, it may be difficult to bring a rear surface the continuous sheet 110 closely into contact with a circumferential surface (a contact face) of the rotary body in a wide range (a long contact distance).

Hence, in an initial state where the applied liquid is not dried, the winding angle θ of the continuous sheet 110 with respect to the heating roller 11 is set to be small, and thus, the contact distance is shortened.

Here, by increasing the curvature of the heating roller 11, a tensile force generated at the time of conveyance of the continuous sheet 110 is changed to a pressing force on a contact portion of the continuous sheet 110 with the heating roller 11. Thus, a contact state of the continuous sheet 110 with the heating roller 11 becomes even. In such a state, cockling or wrinkles do not occur on the continuous sheet 110. When the continuous sheet 110 passes through the heating roller 11, a heat required for evenly drying the liquid on the continuous sheet 110 can be supplied to the continuous sheet 110.

Accordingly, the continuous sheet 110, in which the cockling is reduced and the drying is performed, can closely contact the contact face of the rotary body even when the contact distance of the continuous sheet 110 with the rotary body increases.

Next, an example of a relation between the roller diameter of the heating roller 11 and the cockling of the continuous sheet 110 is described with reference to FIG. 4.

Figures 4, 5:
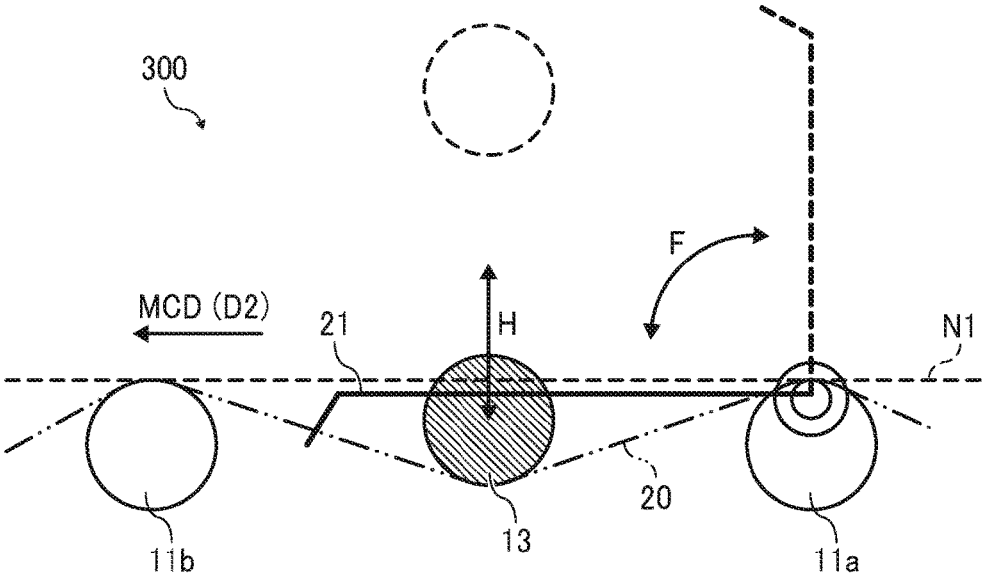
FIG. 4 is a table illustrating a relation between diameters of the heating rollers and cockling.
FIG. 5 is a schematic side view of two adjacent heating rollers and loading guides illustrating the conveyor of the dryer according to the first embodiment.

FIG. 4 is a table of results measuring a height of cockling and a pitch of cockling occurring in the continuous sheet 110 while changing the diameter of the heating roller 11. FIG. 4 further illustrates a presence or an absence of visually observable cockling checked by visual inspection while changing the diameter of the heating roller 11.

From this result, in this example, it is known that the cockling height is almost halved compared with a case where the diameter of the heating roller 11 is 250 mm, by setting the diameter of the heating roller 11 to 200 mm, and the cockling disappears by setting the diameter of the heating roller 11 to be 100 mm or less.

Therefore, the diameter of the heating roller 11 is preferably 200 mm or less, more preferably 100 mm or less.

Therefore, in the heating drum 12 disposed downstream from the heating roller 11, by increasing the contact distance L2 between the continuous sheet 110 and the heating drum 12, the present embodiment can supply heat to the continuous sheet 110 in a short time.

Thus, the present embodiment can improve the drying efficiency and dry the continuous sheet 110 in a short time.

Further, ten heating rollers 11 (11A to 11J) are disposed to surround the heating drum 12.

Here, the heating rollers 11 are disposed equidistantly from the center of the heating drum 12 to the center of each of the heating rollers 11. However, the center of the heating drum 12 need not be coincident with the center of a circular arc of the heating rollers 11, which are disposed in the circular arc arrangement.

Accordingly, a load is not applied to the continuous sheet 110 when the continuous sheet 110 is conveyed in contact with the plurality of heating rollers 11, thus allowing the continuous sheet 110 to be conveyed with a suitable tensile force.

Such a configuration can increase the number of heating rollers 11 and increase the drying rate while reducing an increase in the size of the apparatus.

The circumferential surface of the heating roller 11 on the heating drum 12 side is referred to as an inner region, and the circumferential surface of the heating roller 11 on a side opposite to the heating drum 12 is referred to as an outer region. In this case, since the heating roller 11 rotates, the circumferential portion to be the inner region and the outer region sequentially changes.

Here, the continuous sheet 110 guided by the guide roller 17D is conveyed in D1 direction, which is a first direction, while contacting a portion of the outer region of the circumferential surface of the heating roller 11A to 11J, and reaches the circumferential surface of the heating drum 12. The continuous sheet 110 contacts approximately the entire circumference of the heating drum 12, and passes through the heating drum 12. Then, the continuous sheet 110 is guided again to the heating roller 11J by the guide roller 17E.

The continuous sheet 110 guided by the heating roller 11J is pressed by the pressing rollers 13A to 13J against the inner region of the circumferential surface of the heating rollers 11J to 11A. The continuous sheet 110 is guided and conveyed in a second direction (D2 direction) different with the first direction (D1 direction) in a state contacting the heating rollers 11J to 11A again.

As described above, the conveyance path is a path in which the continuous sheet 110 is conveyed while contacting the heating rollers 11A to 11J. The conveyance path includes a first path Y1 and a second path Y2. In the first path Y1, the continuous sheet 110 is conveyed in the first direction (D1 direction) while contacting the plurality of heating rollers 11A to 11J. In the second path Y2, the continuous sheet 110 is conveyed in the second direction (D2 direction) while contacting the plurality of heating rollers 11J to 11A, to which the continuous sheet 110 contacts in the first path Y1, again.

In this manner, the present embodiment improves the drying rate by contacting the continuous sheet 110 with the contact face (the circumferential surface) of the heating roller 11 twice at different positions simultaneously.

Figure 6:
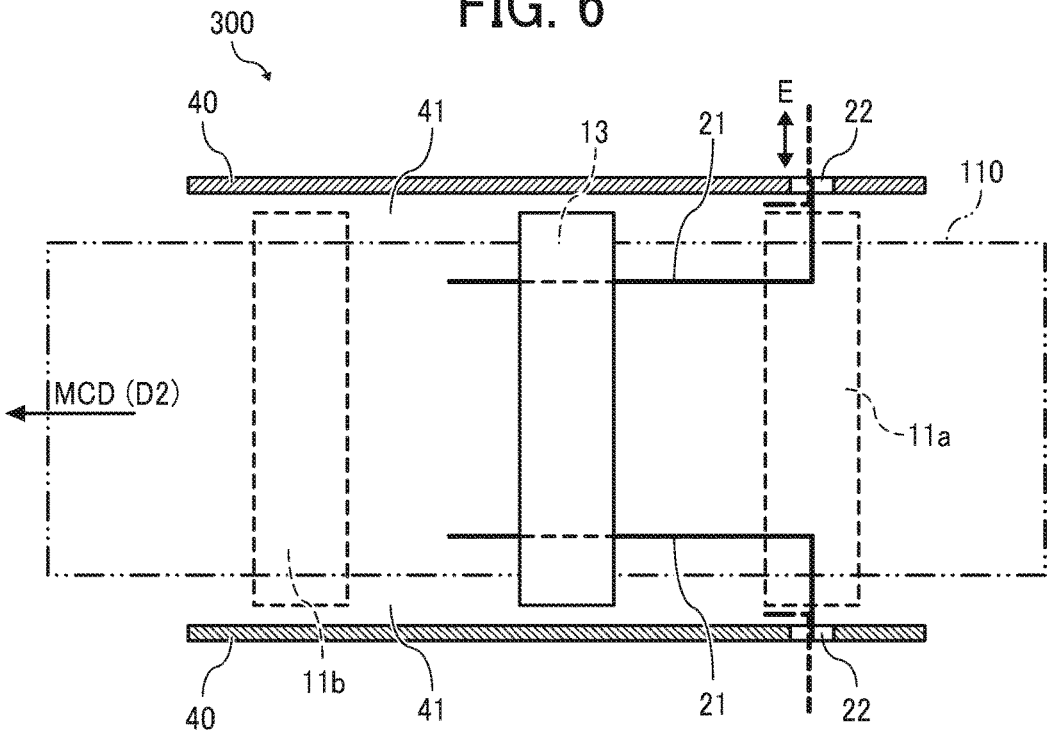
FIG. 6 is a plan view of the conveyor seen from a direction indicated by arrow C in FIG. 2.

Next, the conveyor 300 according to the present disclosure in the dryer is described with reference to FIGS. 5 and 6. FIG. 5 is a side view of a portion of two adjacent heating rollers 11 of the conveyor 300. FIG. 6 is a plan view of the conveyor 300 similarly seen from a direction of the arrow C in FIG. 2.

The conveyor 300 in the dryer 104 includes the two adjacent heating rollers 11 arranged separately from each other and a pressing roller 13 arranged between the two adjacent heating rollers 11.

Here, when the continuous sheet 110 is conveyed along the second path Y2 (D2 direction), the heating roller 11*a* on an upstream side, for example, among the two adjacent heating rollers 11*a* and 11*b* arranged separately constitutes the first guide, and the heating roller 11*b* on a downstream side constitutes a second guide.

For example, the heating roller 11J serves as a first guide between the heating rollers 11J and 11I, and the heating roller 11I serves as a second guide. Further, the heating roller 11I serves as a first guide between the heating rollers 11I and 11H, and the heating roller 11H serves as a second guide.

The pressing roller 13 disposed between the heating rollers 11*a* and 11*b* and forming a non-linear conveyance path 20 between the heating rollers 11*a* and 11*b* constitutes a third guide.

As illustrated in FIG. 5, the pressing roller 13 is movable between a first position (pressing position) and a second position (retracted position). The first position is illustrated by a solid line forming the conveyance path 20 where the continuous sheet 110 is pressed against the heating rollers 11*a* and 11*b*. In the second position (retracted position) illustrated by a broken line, the continuous sheet 110 is not pressed against the heating rollers 11*a* and 11*b*. In other words, the pressing roller 13 is separated from the continuous sheet 110 at the second position.

When loading the continuous sheet 110, the pressing roller 13 moves to the retracted position that is away from a common-outer tangent-line N1 between the heating rollers 11*a* and 11*b*, thereby facilitating the passage of the continuous sheet 110. When the continuous sheet 110 is conveyed, the pressing roller 13 moves to the pressing position to form a non-linear (bent) conveyance path 20 between the heating rollers 11*a* and 11*b*. The pressing position of the pressing roller 13 is disposed at a contact point between the pressing roller 13 and the continuous sheet 110. The contact point is disposed at a center (rotation axis) side of the heating rollers 11*a* and 11*b* with respect to the common-outer tangent-line N1 between the heating rollers 11*a* and 11*b* in a direction indicated by arrow H in FIG. 5.

The dryer 104 includes loading guides 21. The loading guides 21 guide the continuous sheet 110 when the continuous sheet 110 as a medium to be conveyed is loaded in the dryer 104. The loading guides 21 retract from a guiding position when the continuous sheet 110 is conveyed and dried by the heating rollers 11*a* and 11*b*.

The loading guides 21 are L-shaped rod-like members and are held by guide rotating members 22. The guide rotating members 22 are held by apparatus structural bodies such as side plates 40 disposed on both sides of the conveyance path 20.

The loading guides 21 are rotatable in a direction of arrow F between a guiding position illustrated by a solid line in FIG. 5 capable of guiding the continuous sheet 110 and a retracted position illustrated by the broken line in FIG. 5 retracted from the conveyance path 20.

That is, the loading guides 21 are rotatable about an axis (also an axis of the guide rotating members 22) orthogonal to the medium conveyance direction (MCD) of the continuous sheet 110 along a surface of the continuous sheet 110 as the medium. Here, the medium conveyance direction (MCD) is the second path indicated by arrow Y2 in FIGS. 5 and 6.

As indicated by a solid line in FIG. 6, the loading guides 21 are movable between a guiding position and a retraction preparing position. At the guiding position, the loading guides 21 guide the continuous sheet 110. As indicated by a broken line in FIG. 6, at the retraction preparing position, the loading guides 21 are disposed within the gap 41 located between both ends of the continuous sheet 110 and the side plates 40.

Thus, the loading guides 21 do not interfere with the continuous sheet 110 during conveying the continuous sheet 110. In other words, the loading guide 21 is also movable in an axial direction as illustrated by arrow E in FIG. 6. The axial direction is a direction orthogonal to the medium conveyance direction (MCD) of the continuous sheet 110 along the surface of the continuous sheet 110 as the medium.

A rotational mechanism of the loading guides 21 is embodied by, for example, a hand wheel attached to a protruding portion of one end of the loading guide 21 protruding from the side plate 40. Thus, the loading guides 21 are directly rotated by the hand wheel. However, the rotational mechanism of the loading guide 21 is not limited the embodiment described above. For example, a tool mounting hole may be formed in the protruding portion of the loading guide 21 so as to be rotatable by a tool.

Therefore, the loading guide 21 is rotated and moved to the retracted position from a state in which the loading guide 21 has been moved to the retraction preparing position in order to move the loading guide 21 from the guiding position to the retracted position. Further, the loading guide 21 is moved to the guiding position from a state in which the loading guide 21 has been rotated and moved to the retraction preparing position from the retracted position when the loading guide 21 is moved from the retracted position to the guiding position.

Figure 7A:
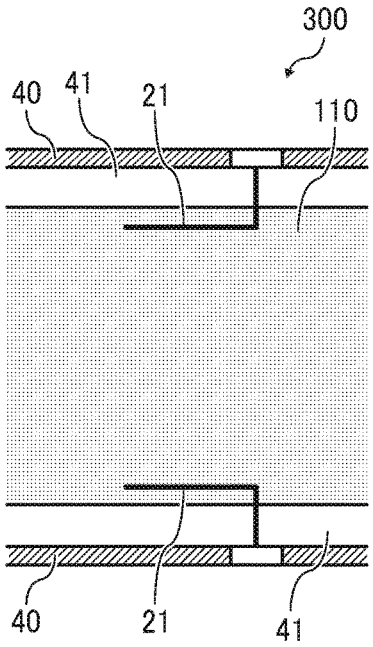
FIGS. 7A through 7C are plan views of the conveyor illustrating an operation of the loading guides.
Figure 7B:
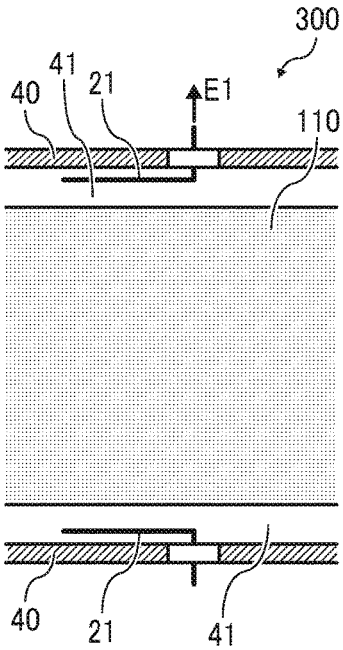
Figure 7C:
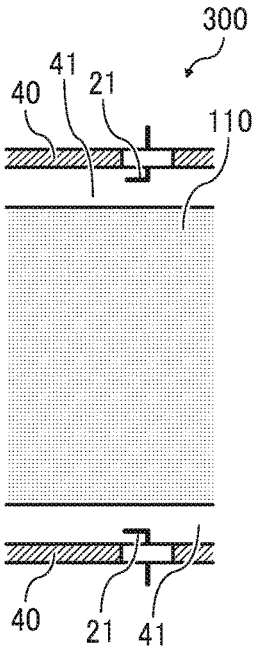
Figure 8A:
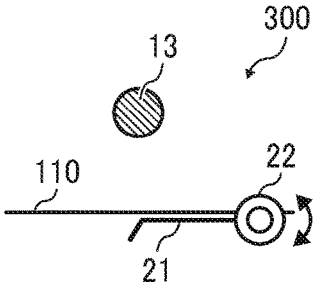
FIGS. 8A through 8C are side views of the conveyor illustrating the operation of the loading guides.
Figure 8B:
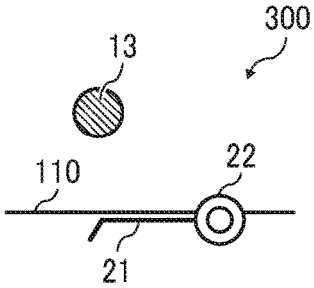
Figure 8C:
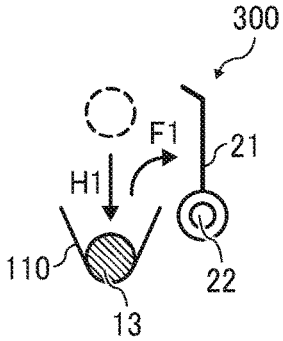

Next, an operation of the loading guides 21 are described with reference to FIGS. 7A through 7C and FIGS. 8A through 8C. FIGS. 7A through 7C are plan views of the loading guides 21. FIG. 8A through 8C are plan views of the loading guides 21.

When loading the continuous sheet 110 along the heating rollers 11*a* and 11*b* of the conveyor 300, the pressing roller 13 moves to the retracted position indicated by broken line in FIG. 5 (the position indicated in FIGS. 7C and 8C).

Then, the loading guide 21 is rotated from the retracted position (the position illustrated by the broken line in FIG. 5) as illustrated in FIG. 7C and FIG. 8C to the retraction preparing position as illustrated in FIGS. 7B and 8B. Then, as illustrated in FIGS. 7A and 8A, the loading guide 21 is moved to the guiding position by pushed in a position opposite a direction of arrow E1 in FIG. 7B for guiding the continuous sheet 110.

In this state, the continuous sheet 110 is moved toward the heating roller 11*b* from the heating roller 11*a*. At this time, a leading end of the continuous sheet 110 is guided by the loading guide 21. Thus, the leading end of the continuous sheet 110 does not enter a gap between the heating rollers 11*a* and 11*b*.

As a result, as illustrated in FIGS. 7A and 8A, the leading end of the continuous sheet 110 reaches the heating roller 11*b*.

Then, as illustrated in FIGS. 7B and 8B, the loading guide 21 is moved in the direction indicated by arrow E1 to the retraction preparing position disposed inside a gap 41 formed between each end of the continuous sheet 110 and the side plate 40. Thus, the loading guide 21 is rotatable without interfering with the loaded continuous sheet 110.

Next, as illustrated in FIGS. 7C and 8C, the loading guide 21 is rotated in a direction indicated by arrow F1 to move to the retracted position. Further, the pressing roller 13 is moved to the pressing position indicated by a solid line in FIG. 8C in a direction indicated by arrow H1 as illustrated in FIG. 8C.

Thus, the loading guide 21 retracted to the retracted position is no longer in contact with the loaded continuous sheet 110. In other words, the loading guide 21 is in a position not guiding the continuous sheet 110 when the continuous sheet 110 is conveyed after the printing operation is started.

In this way, even in the non-linear conveyance path 20, it is possible to easily load the continuous sheet 110 as the medium. When the continuous sheet 110 is conveyed, the present embodiment can prevent damage of the continuous sheet 110 occurred when the continuous sheet 110 rubs against the loading guide 21 or when both ends of the continuous sheet 110 in a width direction is caught by the loading guide 21.

Thus, the loading guide 21 is disposed at a guiding position to guide the medium (continuous sheet) 110 in response to the third guide (pressing rollers 13) disposed at the second position (retracted position). The loading guide 21 is disposed at a retracted position retracted from the guiding position in response to the third guide (pressing rollers 13) disposed at the first position (pressing position).

Figure 9:
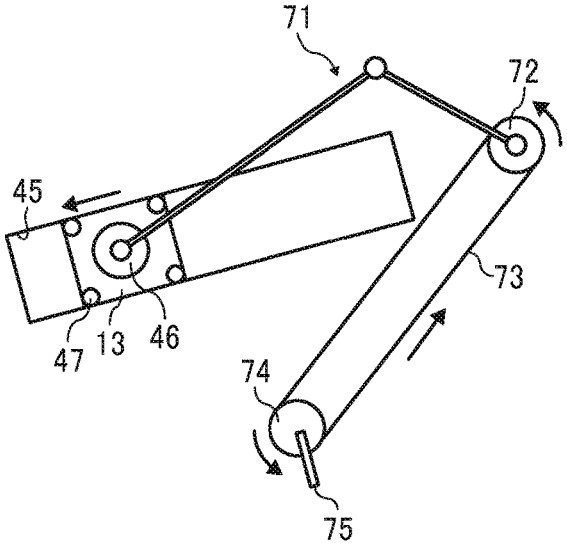
FIG. 9 is a side view of a moving mechanism of a pressing roller.

Here, an example of a moving mechanism of the pressing rollers 13 is described with reference to FIG. 9. FIG. 9 is an explanatory side view of the moving mechanism of the pressing rollers 13.

The pressing rollers 13 are rotatably held by a roller holder 46 movably fitted in a guide groove 45 provided in the side plate 40. Bearings 47 that are in contact with the guide groove 45 are arranged at four corners of the roller holder 46.

The roller holder 46 is connected to the sprocket 72 via a link mechanism 71. The sprocket 72 is connected to the sprocket 74 via a chain 73. The sprocket 74 is rotationally driven by a manual hand wheel 75 (or an actuator such as a motor).

As a result, by rotating the sprocket 74 in the direction of the arrow Y4 in FIG. 9, the roller holder 46 moves in the direction of the arrow Y3 via the chain 73, the sprocket 72, and the link mechanism 71. Thus, the pressing roller 13 moves to the pressing position. When the sprocket 74 is rotated in the direction opposite to the direction of the arrow Y4 in FIG. 9, the roller holder 46 moves in the direction opposite to the direction of the arrow Y3. Thus, the pressing roller 13 moves to the retracted position.

Next, referring to FIGS. 10 through 14, the operation of loading the continuous sheet 110 in the dryer 104 including the above-described conveyor 300 according to the present disclosure. FIGS. 10 through 14 are side views used illustrating the operation of loading the continuous sheet 110.

The movable loading guide 21 described above is disposed between each of the heating rollers 11. Fixed guides 25*a* to 25*c* fixed to the dryer 104 guide the continuous sheet 110. The fixed guides 25*a* to 25*c* are disposed in a region where the fixed guides 25*a* to 25*c* do not interfere with the pressing rollers 13.

Figure 10:
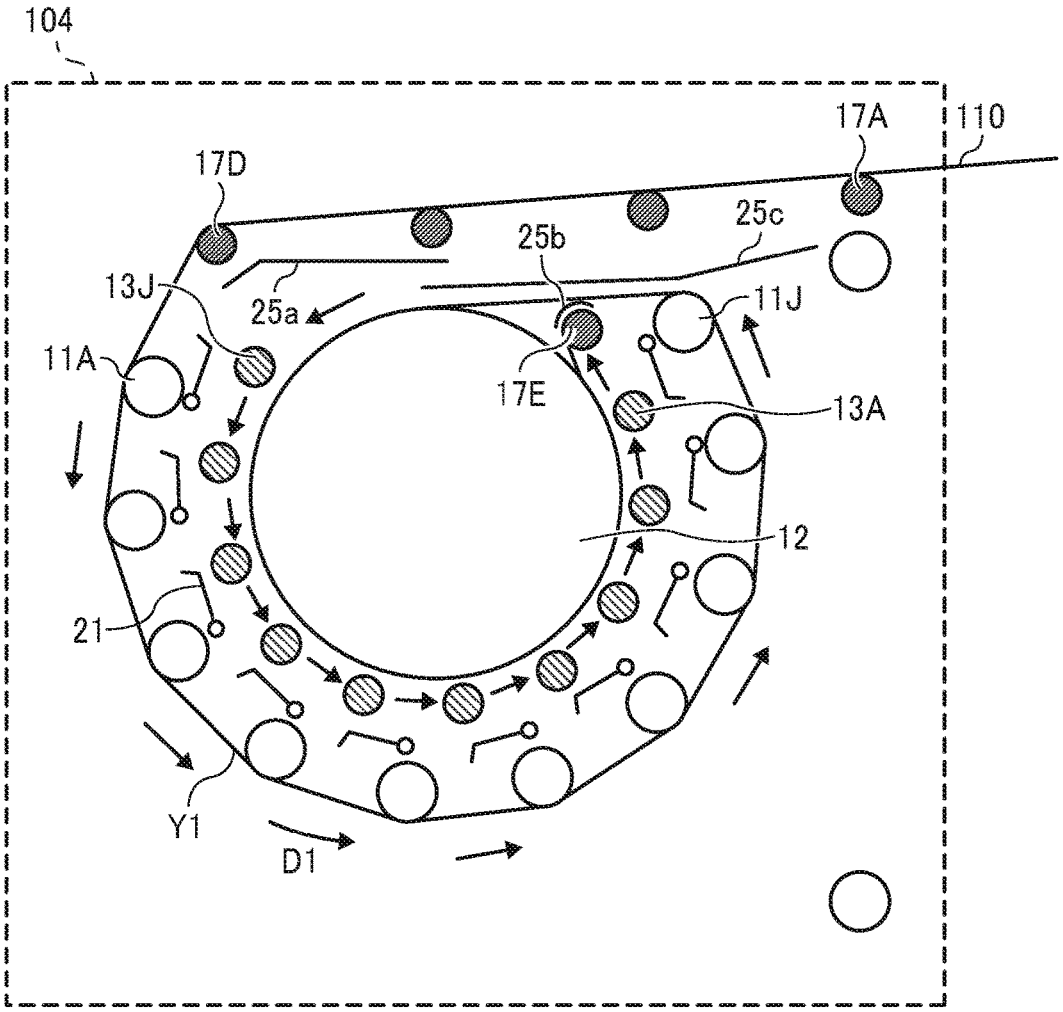
FIG. 10 is a schematic side view of the dryer illustrating a loading operation of the continuous sheet to the dryer.

First, as illustrated in FIG. 10, when loading the continuous sheet 110 in the dryer 104, the pressing roller 13 is moved to the retracted position. Thus, a space between the pressing rollers 13 and the heating rollers 11 is opened. Further, the loading guides 21 move to the guiding position. Arrows in FIG. 10 indicate the medium conveyance direction (sheet passing direction) of the continuous sheet 110.

Figure 11:
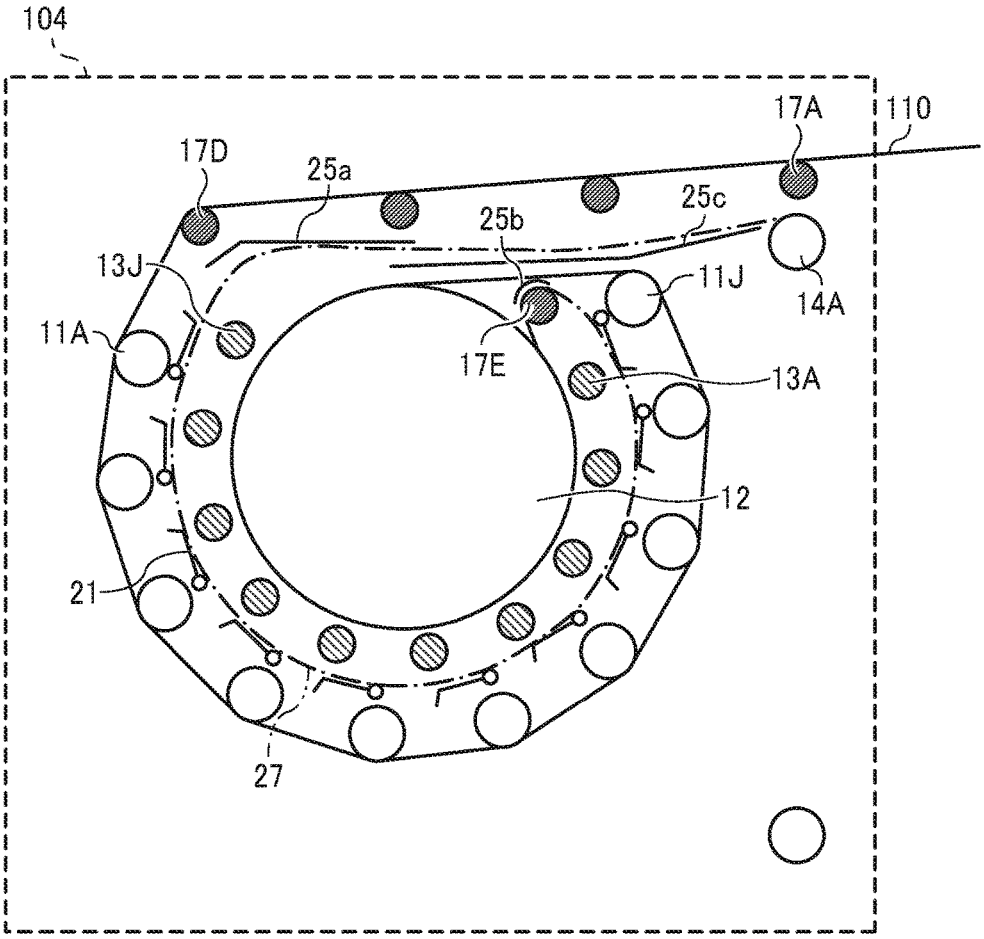
FIG. 11 is a side view of the dryer illustrating the loading operation subsequent to FIG. 10.

Then, as illustrated in FIG. 11, the continuous sheet 110 is wound around the outer periphery of the heating drum 12 through outer regions of the guide rollers 17A to 17D and outer regions of the heating rollers 11A to 11J, and is guided to the guide roller 17E from the heating drum 12.

While guiding the leading end of the continuous sheet 110 reached to the guide roller 17E by the guide member 25*c*, the leading end of the continuous sheet 110 is passed an outer periphery of the guide roller 17E. Then, the medium conveyance direction of the continuous sheet 110 is reversed from the first direction Y1 to the second direction Y2.

Figure 12:
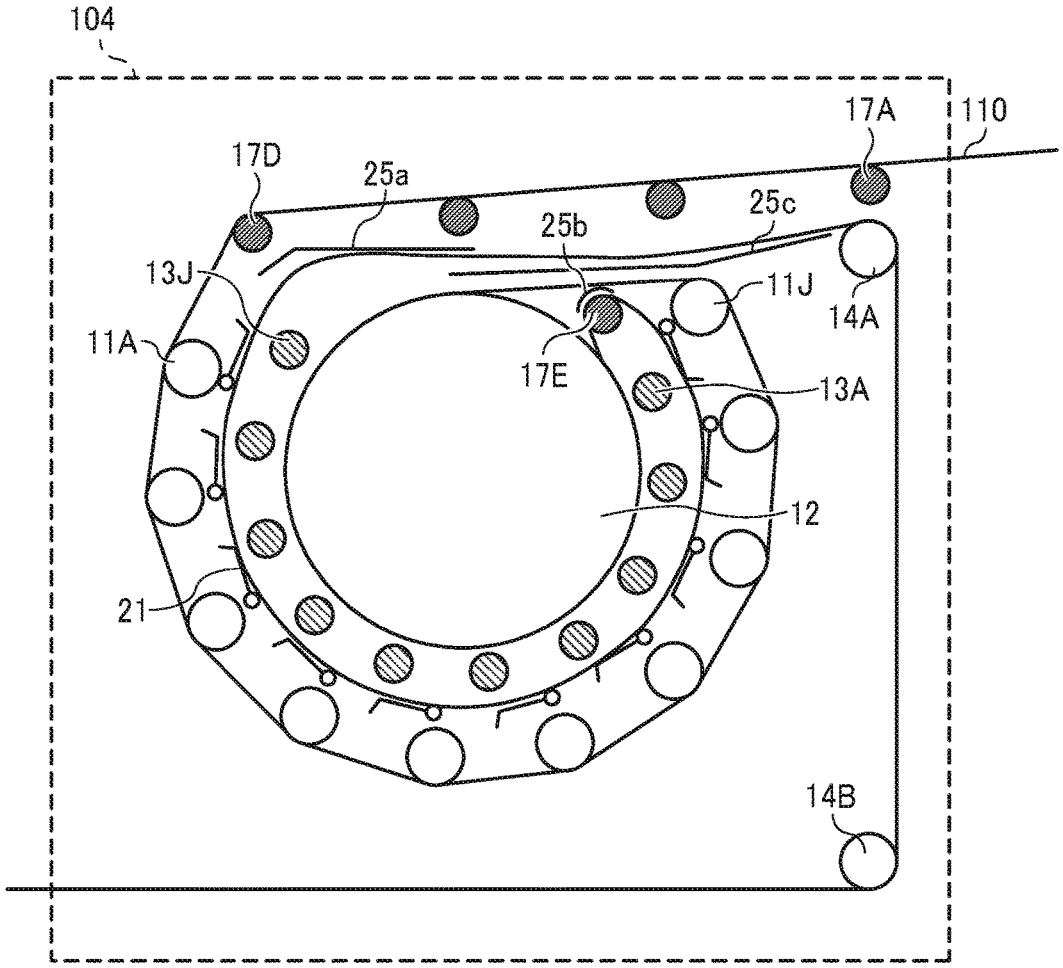
FIG. 12 is a side view of the dryer illustrating the loading operation subsequent to FIG. 11.

Then, the leading end of the continuous sheet 110 is guided by the loading guide 21 and moved along a path 27 indicated by a dashed line to reach the heating roller 14A via the guide members 25*b* and 25*c*. The leading end of the continuous sheet 110 then passes through the heating roller 14B and is drawn out of the dryer 104. As a result, as illustrated in FIG. 12, the continuous sheet 110 passes through the inside of the conveyor 300 of the dryer 104.

Figure 13:
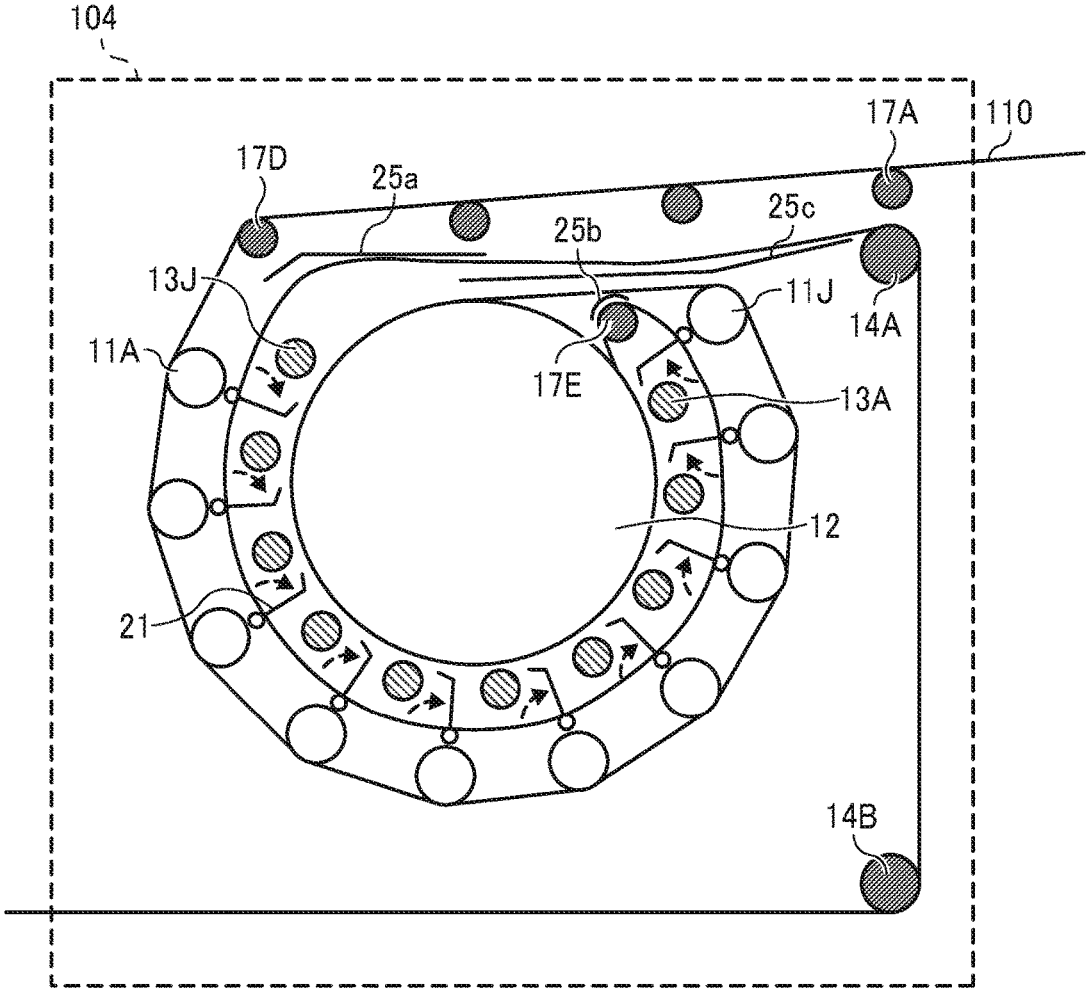
FIG. 13 is a side view of the dryer illustrating the loading operation subsequent to FIG. 12.
Figure 14:
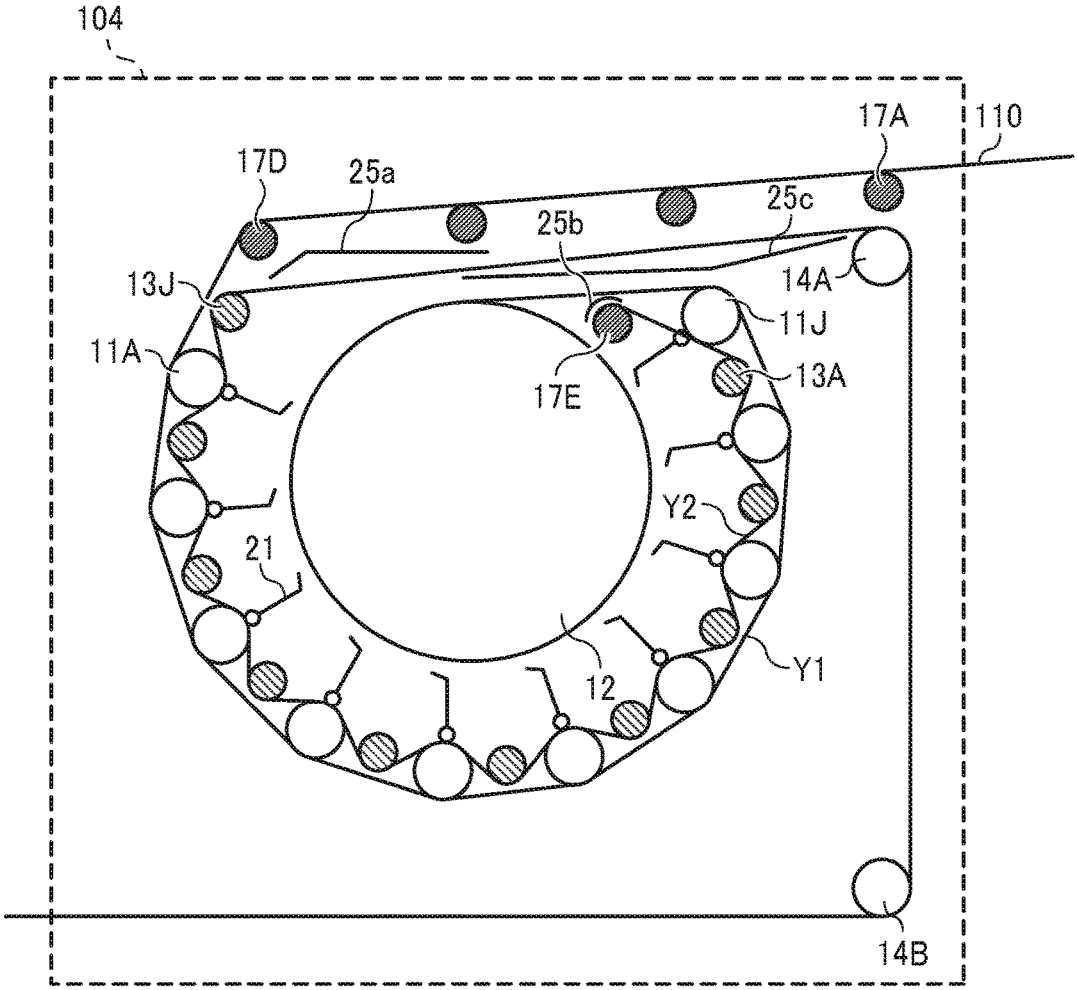
FIG. 14 is a side view of the dryer illustrating the loading operation subsequent to FIG. 13.

Then, as illustrated in FIG. 13, the loading guides 21 are withdrawn to the retracted position, and the pressing rollers 13 are moved to the pressing position as illustrated in FIG. 14. Thus, the continuous sheet 110 is loaded along the second path Y2 so that the printer 1000 can start the printing operation.

Then, as described above, when the printer 1000 starts the printing operation, the continuous sheet 110 is conveyed to the dryer 104. At this time, the loading guide 21 is at the retracted position and does not guide the continuous sheet 110.

Thus, the present embodiment can improve a workability of loading the continuous sheet 110 in the dryer 104 by providing the loading guides 21 that guides the continuous sheet 110 when loading the continuous sheet 110 and moves to the retracted position not guiding the continuous sheet 110 when the continuous sheet 110 is conveyed by the conveyor 300 of the dryer 104.

Particularly, in this dryer 104, a plurality of heating rollers 11 serving as guides are disposed in an arc shape. The present embodiment can prevent the leading end of the continuous sheet 110 to enter into a space between the heating rollers 11 when the continuous sheet 110 passes through the outer region (first path Y1).

However, when the continuous sheet 110 is passed through the inner region (the second path Y2) of the plurality of heating rollers 11, even if the pressing roller 13 is separated, the leading end of the continuous sheet 110 hits the downstream heating roller 11. Thus, the continuous sheet 110 easily enters into a space between the two heating rollers 11. Thus, the conveyor 300 provided with the loading guide 21 can prevent the leading end of the continuous sheet 110 from contacting a downstream side of the heating roller 11 and entering into the space between two heating rollers 11. Thus, the present embodiment facilitates the loading operation of the continuous sheet 110.

In this case, if the loading guide 21 is fixedly arranged between the two heating rollers 11, the continuous sheet 110 may be damaged by contacting with the loading guide 21 during conveying the continuous sheet 110. Therefore, the present embodiment has a configuration in which the loading guides 21 are retracted to the retracted position where the loading guides 21 do not guide the continuous sheet 110 during conveying the continuous sheet 110.

Thus, the present embodiment can prevent the continuous sheet 110 from being damaged during conveying the continuous sheet 110. At the same time, the present embodiment can facilitate the loading operation of the continuous sheet 110 to the dryer 104.

The present embodiment has a configuration in which a plurality of first to third guides is arranged in an arc (or, similarly, in a curved shape).

In this configuration, the leading end of the continuous sheet 110 is easily entering into a space between the first guide and the second guide during loading the continuous sheet 110 to the dryer 104.

Therefore, the present embodiment makes the loading operation easier by disposing the loading guide 21 at each space between the first guide and the second guide.

Thus, the conveyor 300 includes a plurality of the first guides and a plurality of the second guides (heating rollers 11) arranged in an arc.

Further, the conveyor 300 includes a plurality of third guides (pressing rollers 13) and a plurality of loading guides 21. Each of the plurality of first guides and the plurality of second guide (heating rollers 11), and the plurality of third guides (pressing rollers 13) includes rollers.

The conveyance path 20 includes a first path Y1 defined by an outer region of the plurality of first guides and the plurality of second guides (heating rollers 11) arranged in the circular arc shape and a second path Y2 defined by an inner region of the plurality of first guides and the plurality of the second guide (heating rollers 11) arranged in the circular arc shape. The plurality of third guides (pressing rollers 13) and the plurality of loading guides 21 are disposed in the second path Y2 to form the second path Y2.

The medium (continuous sheet) 110 is first conveyed through the first path Y1 while contacting the outer region of the plurality of first guides and the plurality of second guides (heating rollers 11) and then conveyed through the second path Y2 while contacting the inner region of the plurality of first guides and the plurality of second guides (heating rollers 11).

Next, a second embodiment of the conveyor 300 according to the present disclosure is described with reference to FIG. 15. FIG. 15 is a front view of the conveyor 300.

The present embodiment includes a roller holder 49 that rotatably holds both ends of the pressing roller 13 disposed in the gap 42 formed between the two side plates 40. The loading guide 21 is held movably in an axial direction with respect to the side plates 40.

As illustrated in FIG. 15 A, the loading guides 21 guides the continuous sheet 110 when the pressing roller 13 is retracted to the retracted position and the loading guide 21 is moving to the guiding position to support the lower side of the continuous sheet 110.

Figure 15B:
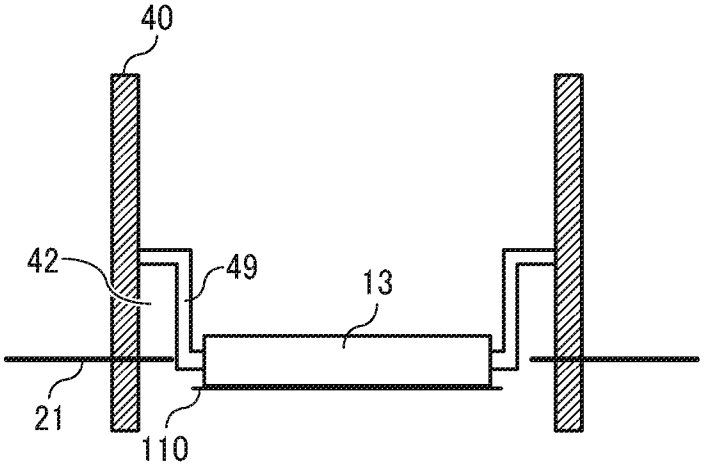
FIGS. 15A and 15B are schematic front views of the loading guide of the conveyor according to a second embodiment of the present disclosure.
Figure 15A:
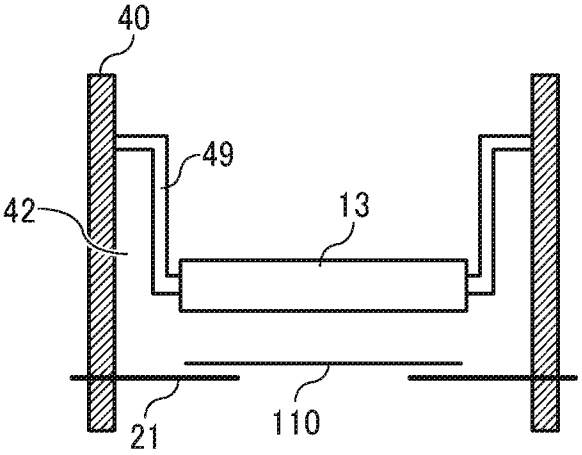

From this state, the loading guide 21 is pulled out until the tip of the loading guide 21 is positioned in the gap 42 when the pressing roller 13 moves to the pressing position as illustrated in FIG. 15B. This prevents the pressing roller 13 to interfere with the loading guide 21 when the pressing roller 13 moves to the pressing position.

Next, a third embodiment of the conveyor 300 according to the present disclosure is described with reference to FIG. 16. FIG. 16 is a schematic side view of the loading guide according to the third embodiment.

Figure 16A:
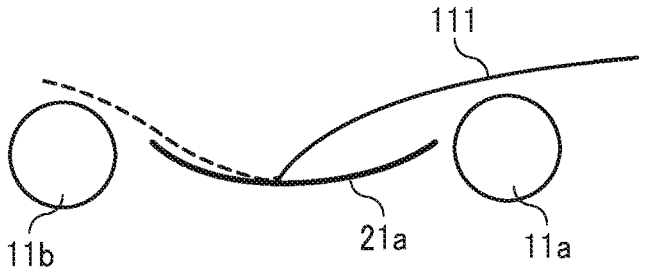
FIGS. 16A through 16C are side views of the loading guide of the conveyor according to a third embodiment of the present disclosure.

The loading guide 21 illustrated in FIG. 16A includes a guide 21*a* having a curved shape concaved toward the pressing roller (third guide) 13.

As a result, when the leading end of the continuous sheet 110 contacts the guide 21*a*, a conveying direction of the continuous sheet 110 is bent in a direction toward an outer periphery of a downstream heating roller 11*b* as illustrated by the broken line.

Thus, the continuous sheet 110 is smoothly conveyed to the outer periphery of the downstream heating roller 11*b*. Here, an upstream side of the heating roller 11*a* is referred to as "an upstream heating roller 11*a*", and a downstream side of the heating roller 11*b* is referred to as "a downstream heating roller 11*b*".

Figure 16B:
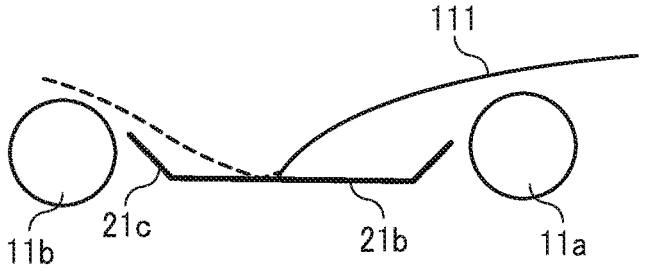

The loading guide 21 illustrated in FIG. 16B has a tray-shaped guide 21*b*, both ends of which are concaved toward the pressing roller 13 and has a wall 21*c* rising obliquely on the downstream in the medium conveyance direction. The loading guide 21 serves as a conveyance guide of the continuous sheet 110.

As a result, the leading end of the continuous sheet 110 is fed and brought into contact with the tray-shaped guide 21*b*. Thus, the traveling direction is bent toward the outer periphery of the downstream heating roller 11*b* as illustrated by the broken line in FIG. 16B. Thus, the leading end of the continuous sheet 110 is sent smoothly to the outer peripheral surface of the downstream heating roller 11*b*.

Figure 16C:
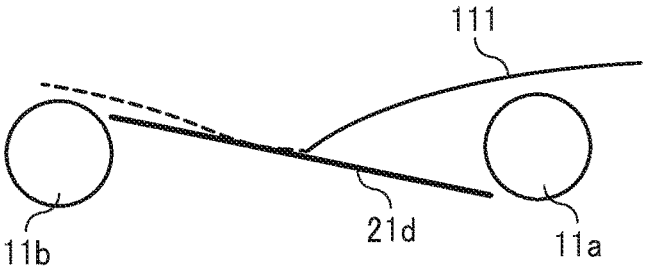

The loading guide 21 as illustrated in FIG. 16C has a guide 21*d* inclined to rise toward an upper surface of the downstream heating roller 11*b* along a common inner tangent line between the upstream heating roller 11*a* and the downstream heating roller 11*b*. The common inner tangent line is a line connecting the upper surface of the downstream heating roller 11*a* and a lower surface of the upstream heating roller 11*a*. The inclination of the guide 21*a* is not limited to be the same as the inclination of the common inner tangent line.

As a result, the leading end of the continuous sheet 110 is brought into contact with the guide 21*a* while the continuous sheet 110 is fed to the conveyor 300. Thus, the traveling direction of the continuous sheet 110 is bent toward the outer periphery of the downstream heating roller 11*b* as illustrated by the broken line in FIG. 16C. Thus, the continuous sheet 110 is smoothly conveyed to the outer peripheral surface of the downstream heating roller 11*b*.

Figure 17A:
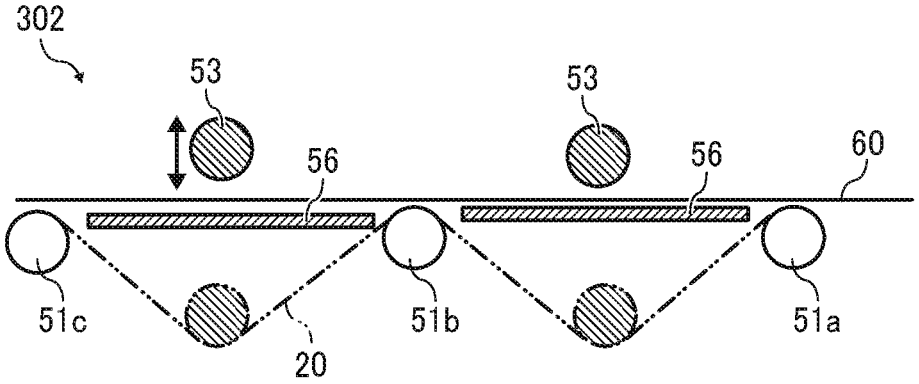
FIGS. 17A and 17B are schematic side views of the loading guide of the conveyor according to a fourth embodiment of the present disclosure.
Figure 17B:
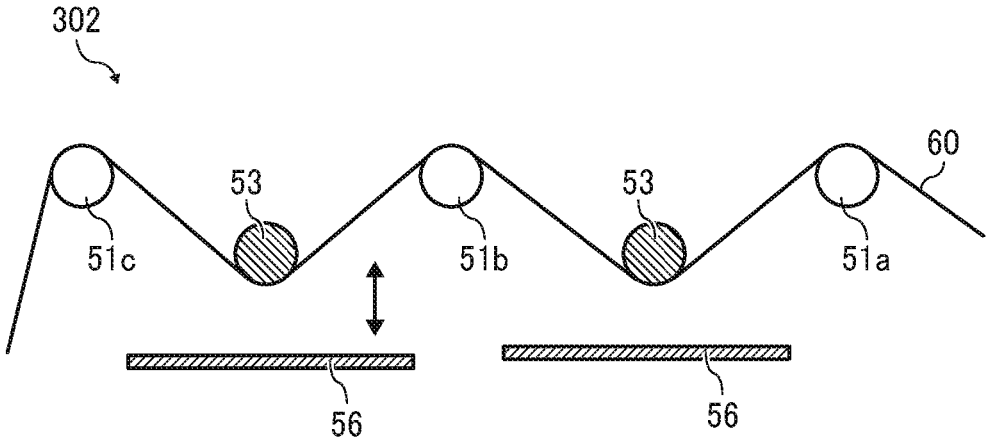

A third embodiment of the conveyor 302 according to the present disclosure is described with reference to FIGS. 17A and 17B. FIGS. 17A and 17B are side views of the conveyor 302.

In this embodiment, the conveyor 302 includes a plurality (here, three) of rollers 51 (51*a* to 51*c* in this case) and a plurality of pressing rollers 53 arranged between two adjacent rollers 51. The plurality of rollers 51 serves as the first guide and the second guide described above. The plurality of pressing rollers 53 serves as the third guide described above. The conveyor 302 includes loading guides 56 located between the two adjacent rollers 51. The loading guides 56 are disposed between the two adjacent rollers 51 to face the pressing rollers.

The pressing rollers 53 are movable between a pressing position as illustrated in FIG. 17B and a retracted position as illustrated in FIG. 17A in a direction indicated by arrow in FIGS. 17A and 17B. The pressing rollers 53 form a non-linear (folded shaped) conveyance path 20 between the rollers 51 at the pressing position. The pressing rollers 53 retract from the conveyance path 20 at a retracted position.

The medium 60 is pressed against the rollers 51 by moving the pressing rollers 53 to the pressing position as illustrated in FIG. 17B. Thus, the non-linear conveyance path 20 is defined by the rollers 51. Further, as the pressing rollers 53 move to the retracted position as illustrated in FIG. 17A, the pressing rollers 53 separate from the common external tangent of the rollers 51.

The loading guides 56 move to a guiding position for guiding the medium 60 as illustrated in FIG. 17A when loading the medium 60 in the apparatus. The loading guides 56 move to a retracted position at which the loading guides 56 does not guide the medium 60 as illustrated in FIG. 17B when the medium 60 is conveyed.

In the first embodiment as illustrated in FIGS. 2 and 14, the continuous sheet 110 contacts two places (outer region Y1 and inner region Y2) of the heating rollers 11 at the same time. However, unlike the first embodiment, the third embodiment can retract the loading guides 56 to a position opposite the pressing rollers 53 since the medium 60 contacts only upper surfaces (inner region Y2) of the rollers 51.

Therefore, the present embodiment has a configuration in which the loading guides 56 move between the guiding position and the retracted position only by ascending and descending the loading guides 56.

In this case, the present embodiment may have a configuration in which the pressing rollers 53 and the loading guides 56 may have a common moving mechanism. The pressing rollers 53 and the loading guides 56 may ascend and descend as a single unit by rotating the above-mentioned manual hand wheel 75 to drive the common moving mechanism.

In each of the above-described embodiments, the first guide, the second guide, and the third guide are described as rollers. However, the first guide, the second guide, and the third guide of the present disclosure are not limited to rollers. For example, the first guide, the second guide, and the third guide may be configured with a curved member. As an example of the curved member is a curved surface heater, for example, if the first guide, the second guide, and the third guide are heaters.

Figure 18:
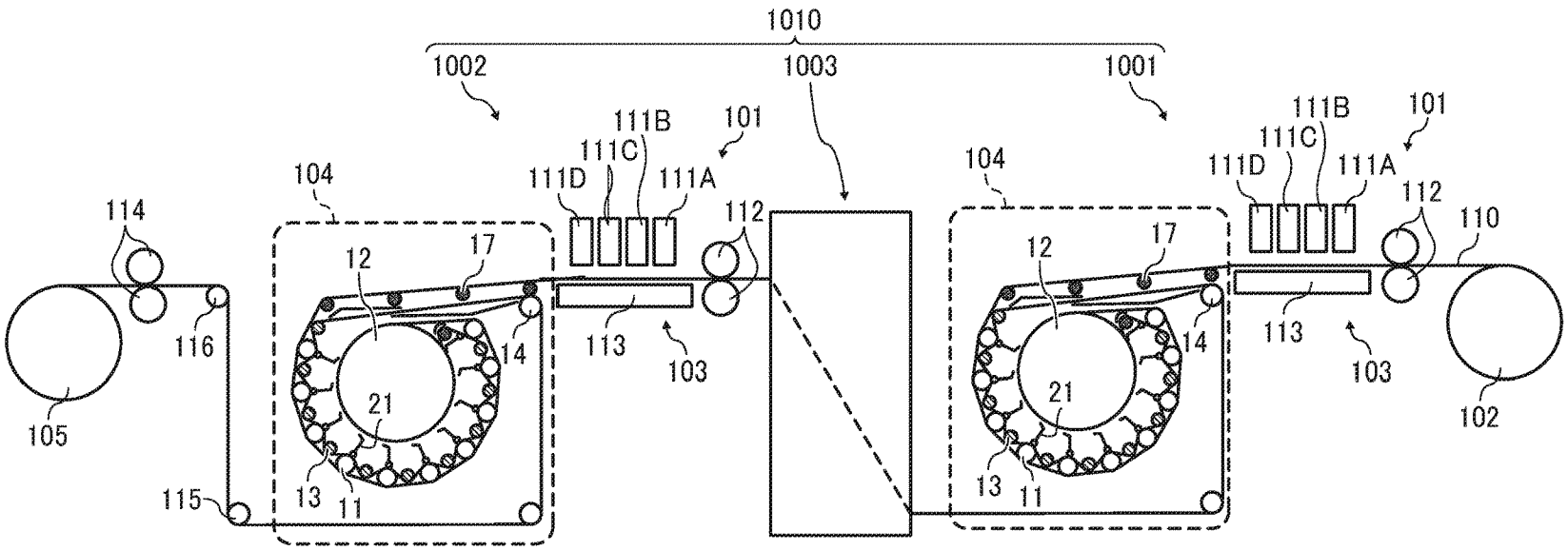
FIG. 18 is a schematic view of a printer according to a fifth embodiment of the present disclosure.

A printer 1010 according to a fourth embodiment of the present disclosure is described with reference to FIG. 18. FIG. 18 is a schematic front view of the printer 1010.

The printer 1010 includes a feeding roller 102, a first printer 1001, a reversing unit 1003, a second printer 1002, and a winding roller 105. The first printer 1001, a reversing unit 1003, and a second printer 1002 are disposed between the feeding roller 102 and the winding roller 105.

The first printer 1001 performs printing and drying of a first surface of the continuous sheet 110. The reversing unit 1003 reverses the first surface of the continuous sheet 110, to which image is printed by the first printer 1001, to a second surface of the continuous sheet 110. The second printer 1002 performs printing and drying of the second surface of the continuous sheet 110.

The configuration of the liquid applier 101, the conveyance unit 103, and the dryer 104 of the first printer 1001 and the second printer 1002 is approximately identical to the configuration of the first embodiment. However, the configuration is not limited to the first embodiment, and other configurations may be applied.

Here, the liquid applier 101 of the first printer 1001 is a first liquid applier to apply the liquid onto the first surface of the continuous sheet 110 that is the medium to be conveyed. Here, the liquid applier 101 of the second printer 1002 is a second liquid applier to apply the liquid onto the second surface opposite the first surface of the continuous sheet 110 that is the medium to be conveyed.

The dryer 104 of the first printer 1001 is a first dryer to which the second surface of the continuous sheet 110 contacts the heating roller 11. The dryer 104 of the second printer 1002 is a second dryer to which the first surface of the continuous sheet 110 contacts the heating roller 11.

When a liquid discharge head is used as the liquid applicator, examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The terms "image formation", "recording", "printing", "image printing", and "fabricating" used herein may be used synonymously with each other.

Herein, the liquid to be applied to the medium to be conveyed is not particularly limited, but it is preferable that the liquid has a viscosity of less than or equal to 30 mPa·s under normal temperature and at normal pressure or by being heated or cooled.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, suspension, or emulsion can be, e.g., inkjet ink, surface treatment solution, a liquid for forming components of electronic element or light-emitting element or a resist pattern of electronic circuit, or a material solution for three-dimensional fabrication.

"A liquid discharge device" is an integrated unit including the head and a functional part(s) or unit(s), and is an assembly of parts relating to liquid discharge. For example, "the liquid discharge device" may be a combination of the head with at least one of a head tank, a carriage, a supply unit, a maintenance unit, and a drive unit.

Herein, the terms "integrated" or "united" mean fixing the head and the functional parts (or mechanism) to each other by fastening, screwing, binding, or engaging and holding one of the head and the functional parts movably relative to the other. The head may be detachably attached to the functional part(s) or unit(s) each other.

For example, the head and a head tank may be integrated into a single unit as the liquid discharge device. The head and the head tank may be connected each other via, e.g., a tube to integrally form the liquid discharge device. Here, a unit including a filter may further be added to a portion between the head tank and the head of the liquid discharge device.

The liquid discharge device may be an integrated unit in which a head is integrated with a carriage.

The liquid discharge device may be the head movably held by a guide that forms part of a drive unit, so that the head and the drive unit are integrated as a single unit. The liquid discharge device may include the head, the carriage, and the drive unit that are integrated as a single unit.

In another example, a cap that forms part of a maintenance unit is secured to the carriage mounting the head so that the head, the carriage, and the maintenance unit are integrated as a single unit to form the liquid discharge device.

Further, the liquid discharge device may include tubes connected to the head mounted on the head tank or the channel member so that the head and the supply unit are integrated as a single unit. Liquid is supplied from a liquid reservoir source such as liquid cartridge to the head through the tube.

The drive unit may be a guide only. The supply unit may be a tube(s) only or a mount part (loading unit) only.

The term "liquid discharge apparatus" used herein also represents an apparatus including the head or the liquid discharge device to discharge liquid by driving the head. The liquid discharge apparatus may be, for example, an apparatus capable of discharging liquid onto a material to which liquid can adhere or an apparatus to discharge liquid into a gas or another liquid.

The "liquid discharge apparatus" may include devices to feed, convey, and eject the material to which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid onto a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate, a wooden or plastic board, and piezoelectric element, and media, such as powder layer, organ model, and testing cell.

Examples of the "material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of "the liquid discharge apparatus" further include a treatment liquid coating apparatus to discharge a treatment liquid onto a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A conveyor for a printer, comprising:

a first guide;

a second guide disposed separately from the first guide;

a third guide disposed between the first guide and the second guide, the first guide, the second guide, and the third guide defining a conveyance path along which a medium is conveyed; and a loading guide movable to guide the medium between the first guide and the second guide, the third guide movable between a first position and a second position, the third guide pressing the medium to the first guide and the second guide at the first position, the third guide separated from the medium at the second position, the loading guide disposed at a guiding position to guide the medium, and the loading guide disposed at a retracted position to be separated from the medium during conveying the medium in response to the third guide disposed at the first position.

2. The conveyor according to claim 1, wherein the loading guide is rotatable about an axis orthogonal to a direction of conveyance of the medium along a surface of the medium, and the loading guide is movable in a direction along the axis.

3. The conveyor according to claim 1, wherein the loading guide is movable in a direction orthogonal to a direction of conveyance of the medium along a surface of the medium.

4. The conveyor according to claim 1, wherein the loading guide includes a guide having a curved shape concaved toward the third guide.

5. The conveyor according to claim 1, wherein the loading guide has a guide, ends of which are concaved toward the third guide, and the guide has a wall rising obliquely on downstream side in a direction of conveyance of the medium.

6. The conveyor according to claim 1, further comprising a plurality of first guides and a plurality of second guides arranged in an arc.

7. The conveyor according to claim 6, further comprising a plurality of third guides and a plurality of loading guides, wherein each of the plurality of first guides, the plurality of second guides, and the plurality of third guides includes rollers, the conveyance path includes a first path defined by an outer region of the plurality of first guides and the plurality of second guides arranged in the arc and a second path defined by an inner region of the plurality of first guides and the plurality of the second guide arranged in the arc, and the plurality of third guides is disposed in the second path to form the second path.

8. The conveyor according to claim 7, wherein the medium is first conveyed through the first path while contacting the outer region of the plurality of first guides and the plurality of second guides and then conveyed through the second path while contacting the inner region of the plurality of first guides and the plurality of second guides.

9. A dryer for drying a medium to be conveyed to which a liquid is applied, the dryer comprising the conveyor according to claim 1.

10. The dryer according to claim 9, wherein the first guide and the second guide are heating rollers.

11. A dryer for drying a medium to which a liquid is applied, the dryer comprising:

a heating drum to heat and dry the medium;

a plurality of heating rollers disposed separately around the heating drum, defining a conveyance path along which the medium is conveyed while contacting the plurality of heating rollers;

a pressing roller disposed between adjacent two of the plurality of heating rollers; and a loading guide movable to guide the medium along an inner region of the plurality of heating rollers defined by the plurality of heating rollers and the heating drum, the pressing roller movable between a first position and a second position, the pressing roller pressing the medium to the plurality of heating roller at the first position, the pressing roller separated from the medium at the second position, the loading guide disposed at a guiding position to guide the medium, and the loading guide disposed at a retracted position to be separated from the medium during conveying the medium in response to the pressing roller disposed at the first position.

12. The dryer according to claim 11, wherein the loading guide is disposed at the guiding position in response to the pressing roller disposed at the second position.

13. A printer comprising:

a liquid applier to apply liquid to a medium; and the dryer according to claim 9.

* * * * *